US009151189B2

(12) United States Patent
Toma et al.

(10) Patent No.: US 9,151,189 B2
(45) Date of Patent: Oct. 6, 2015

(54) INTERNAL COMBUSTION ENGINE

(71) Applicant: AISIN SEIKI KABUSHIKI KAISHA, Kariya-shi (JP)

(72) Inventors: Naoto Toma, Kariya (JP); Shigemitsu Suzuki, Takahama (JP); Hiroki Mukaide, Chiryu (JP); Masaki Kobayashi, Okazaki (JP); Kazuo Ueda, Gamagori (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 0 days.

(21) Appl. No.: 14/197,914

(22) Filed: Mar. 5, 2014

(65) Prior Publication Data

US 2014/0283769 A1 Sep. 25, 2014

(30) Foreign Application Priority Data

Mar. 21, 2013 (JP) ..... 2013-058784

(51) Int. Cl.
*F01L 1/34* (2006.01)
*F01L 1/344* (2006.01)

(52) U.S. Cl.
CPC ..... *F01L 1/3442* (2013.01); *F01L 2001/34463* (2013.01); *F01L 2800/03* (2013.01)

(58) Field of Classification Search
CPC ..... F01L 1/3442; F01L 2800/03; F01L 2001/34463; F01L 1/344
USPC ..... 123/90.17
See application file for complete search history.

(56) References Cited

U.S. PATENT DOCUMENTS 5,924,395 A * 7/1999 Moriya et al. ..... 123/90.15
8,281,756 B2 10/2012 Suzuki et al.

FOREIGN PATENT DOCUMENTS

JP 2010-223212 A 10/2010

* cited by examiner

*Primary Examiner* — Zelalem Eshete
(74) *Attorney, Agent, or Firm* — Buchanan Ingersoll & Rooney PC

(57) ABSTRACT

An internal combustion engine includes a variable valve timing control apparatus including a driving-side rotating member rotating about a rotary axis by rotational force transmitted from a crankshaft, a driven-side rotating member including at least one fluid pressure chambers partitioned and formed with at least one advanced angle chambers and at least one retarded angle chambers and integrally rotating with a camshaft for opening and closing a valve, and a lock mechanism configured with a lock member provided at one of the driving-side rotating member and the driven-side rotary member to be engageable and disengageable with a recessed portion formed at the other of the driving-side rotating member and the driven-side rotary member, and an engine control unit for stopping the internal combustion engine to position a portion where the lock mechanism is formed below a virtual line passing through the rotary axis when the internal combustion engine is stopped.

6 Claims, 7 Drawing Sheets

INTERNAL COMBUSTION ENGINE

CROSS REFERENCE TO RELATED APPLICATIONS

This application is based on and claims priority under 35 U.S.C. §119 to Japanese Patent Application 2013-058784, filed on Mar. 21, 2013, the entire content of which is incorporated herein by reference.

TECHNICAL FIELD

This disclosure generally relates to an internal combustion engine.

BACKGROUND DISCUSSION

A known internal combustion engine disclosed in JP2010-223212A (hereinafter referred to as Patent reference 1) includes a variable valve timing control apparatus configured with a driving-side rotating member synchronously driving with a crankshaft and a driven-side rotating member integrally and coaxially rotating with a camshaft.

According to the variable valve timing control apparatus disclosed in Patent reference 1, a vane is formed to be projected on an outer circumference of the driven-side rotating member. A fluid pressure chamber formed between the driving-side rotating member and the driven-side rotating member is divided by the vane to form an advanced angle chamber and a retarded angle chamber. A lock mechanism is configured such that a recessed portion is formed on the outer circumference of the driven-side rotating member and a lock member, corresponding to a lock piece disclosed in Patent reference 1, engaging and disengaging with the recessed portion is formed in a projectable and retractable manner from an inner circumference of the driving-side rotating member.

According to Patent reference 1, respective oil paths communicating with the advanced angle chamber and the retarded angle chamber are formed to shift, or change a relative rotational phase of the driving-side rotating member and the driven-side rotating member in an advanced angle direction and in a retarded angle direction. Further, an oil path is formed for unlocking the lock mechanism by supplying hydraulic oil to the recessed portion in a state where the lock mechanism is locked.

Particularly, the variable valve control apparatus disclosed in Patent reference 1 is configured to slightly leak the hydraulic oil while including an air inflow mechanism that positively discharges the hydraulic oil from the retarded angle chamber of the variable valve control apparatus when the internal combustion engine is stopped.

Comparing to a known variable valve timing control apparatus that leaves hydraulic oil in a fluid pressure chamber, the variable valve control apparatus including the air inflow mechanism as disclosed in Patent reference 1 easily shifts, or changes the relative rotational phase of the driving-side rotating member and the driven-side rotating member in a short time to establish the required relative rotational phase when the internal combustion engine is started. However, the air inflow mechanism disclosed in Patent reference 1 is configured to be closed by centrifugal force against the spring force when the variable valve control apparatus is rotated and to be opened by the spring force when the rotation of the variable valve control apparatus is stopped. Accordingly, the number of components is increased and the inflow of air may be impaired in case of operation failure of the air inflow mechanism.

When the operation of the air inflow mechanism is failed, the variable valve control apparatus including the air inflow mechanism as disclosed in Patent reference 1 leaves the hydraulic oil in the fluid pressure chamber. Thus, shifting, or changing the relative rotational phase of the variable valve control apparatus to an intermediate phase is time consuming. For example, when the internal combustion engine is started in a state where the relative rotational phase of the variable valve control apparatus is in the most retarded angle phase, changing the relative rotational phase to the intermediate phase is time consuming.

A need thus exists for an internal combustion engine which is not susceptible to the drawback mentioned above.

SUMMARY

According to an aspect of the disclosure, an internal combustion engine includes a variable valve timing control apparatus including a driving-side rotating member rotating about a rotary axis by rotational force transmitted from a crankshaft of the internal combustion engine, a driven-side rotating member being surrounded by the driving-side rotating member to include at least one fluid pressure chambers partitioned and formed with at least one advanced angle chambers and at least one retarded angle chambers between the driven-side rotating member and an outer circumference of the driving-side rotating member, the driven-side rotating member integrally rotating with a camshaft for opening and closing a valve, and a lock mechanism configured with a lock member provided at one of the driving-side rotating member and the driven-side rotary member to be engageable and disengageable with a recessed portion formed at the other of the driving-side rotating member and the driven-side rotary member. The internal combustion engine further includes an engine control unit for stopping the internal combustion engine to position a portion where the lock mechanism is formed below a virtual line passing through the rotary axis and extending in a horizontal direction when the internal combustion engine is stopped.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
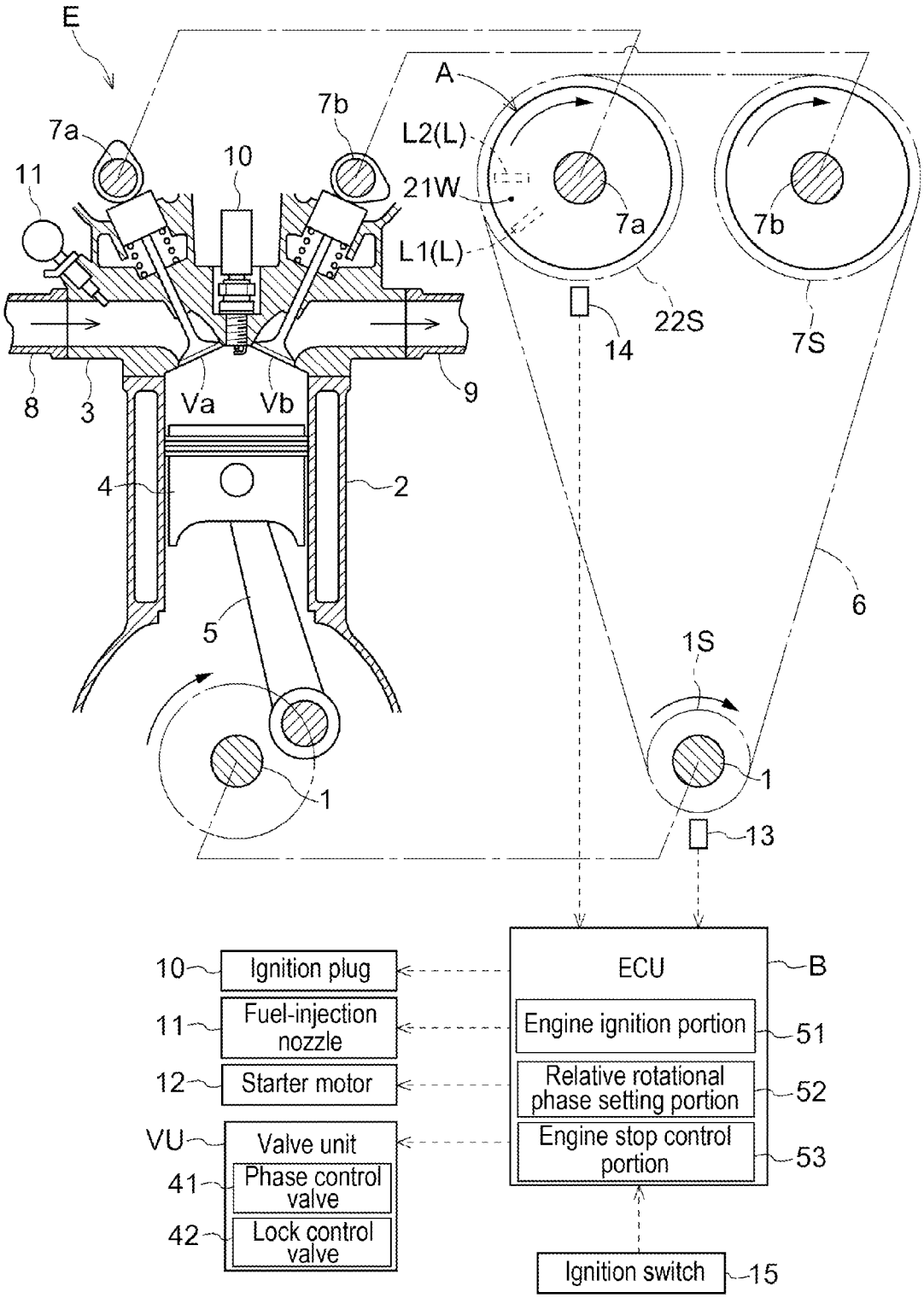
FIG. 1 is a schematic view illustrating an engine, a variable valve control apparatus and an engine control unit according to an embodiment disclosed here.
Figure 2:
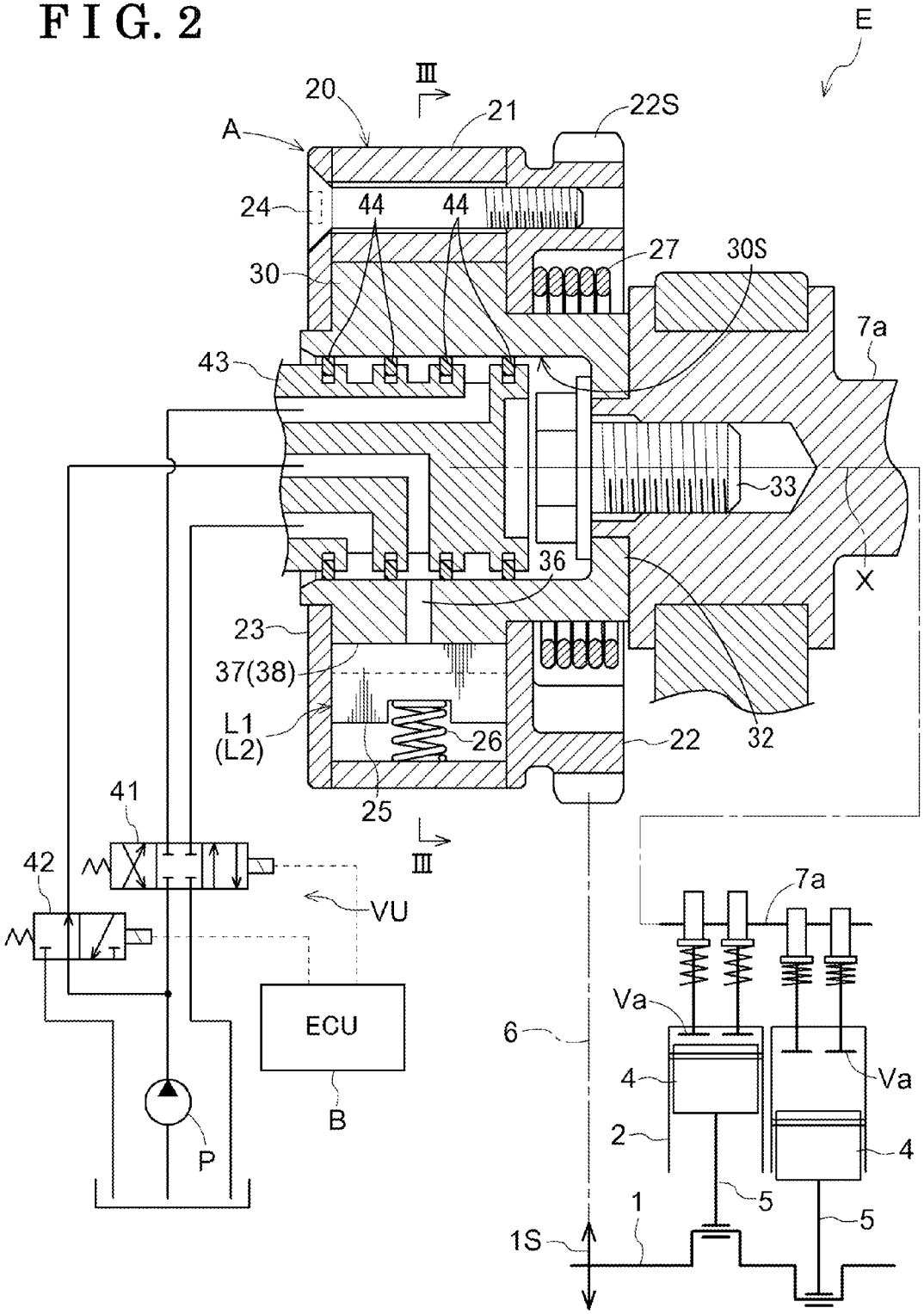
FIG. 2 is a cross-sectional view of the variable valve control apparatus.

An embodiment of this disclosure will be described referring to the attached drawings. As illustrated in FIGS. 1 and 2, an engine E serving as an internal combustion engine includes a variable valve control apparatus A positioned coaxially with an intake cam shaft 7*a*, serving as a cam shaft, and synchronously rotating with a crankshaft 1 for controlling timing to open and close an intake valve Va.

The engine E is configured as a four-cycle engine in which a cylinder head 3 is connected above cylinder block 2, a piston 4 slidably accommodates in each of plural cylinder bores formed in the cylinder blocks 2, and the piston 4 is connected to the crankshaft 1 via a connecting rod 5.

The cylinder head 3 includes the intake valve Va taking air into a combustion chamber and an exhaust valve Vb exhausting combustion gas out of the combustion chamber. The cylinder head 3 further includes an intake cam shaft 7*a* and an exhaust cam shaft 7*b* controlling the intake valve Va and the exhaustion valve Vb, respectively. A timing chain 6 is wound around an output sprocket 1S of the crankshaft 1, a driving sprocket 22S of an outer rotor 20, serving as a driving-side rotating member, of the variable valve control apparatus A, and a shaft sprocket 7S of the exhaust cam shaft 7*b*.

The cylinder head 3 is connected with an intake manifold 8 supplying air into the combustion chamber via the intake valve Va and an exhaust manifold 9 sending exhaust gas out of the combustion chamber via the exhaust valve Vb. The cylinder head 3 includes an ignition plug 10 while the intake manifold 8 includes a fuel-injection nozzle 11. A starter motor 12 applying a rotational force to the crankshaft 1 is provided at an outside of the engine E.

The engine E is configured as the four-cycle engine in which the plural pistons 4 operate intake, compression, combustion and exhaust processes sequentially. Linking with these processes, the rotational force applied by the crankshaft 1 is transmitted to the intake cam shaft 7*a* and the exhaust cam shaft 7*b* via the timing chain 6. Then, the intake valve Va and the exhaust valve Vb are open and closed in synchronization with the rotation of the crankshaft 1.

As described above, the variable valve control apparatus A is positioned coaxially with the intake cam shaft 7*a*. Alternatively, the engine E may be configured with the variable valve timing control apparatus A including the exhaust cam shaft 7*b* for controlling opening and closing timing of the exhaust valve Vb. Further, instead of including the driving sprocket 22S on the outer rotor 20, the outer rotor 20 may include a timing pulley for transmitting the rotational force of the crankshaft 1 using a timing belt. Similarly, a gear may be formed on an outer surface of the outer rotor 20 for transmitting the rotational force of the crankshaft 1 using a gear train.

The engine E is mounted on, for example, a passenger vehicle. The engine E and the variable valve timing control apparatus A are controlled by an engine control unit B, or ECU B. The engine E includes a crank sensor 13 detecting a rotational attitude, or position of the crankshaft 1, and an opening/closing timing sensor 14 positioned close to the variable valve timing control unit A for detecting a rotational attitude, or position of the outer rotor 20 and a relative rotational phase of an inner rotor 30 and the outer rotor 20 (hereinafter referred to as the relative rotational phase).

As illustrated in FIGS. 1 to 5, the variable valve timing control unit A includes the outer rotor 20 serving as the driving-side rotating member synchronously rotating with the crankshaft 1, and the inner rotor 30 serving as the driven-side rotating member connecting with the intake cam shaft 7*a* using a connection bolt 33. The outer rotor 20 and the inner rotor 30 are positioned coaxially with a rotary axis X of the intake cam shaft 7*a* and are relatively rotatable about the rotary axis X. The variable valve timing control apparatus A is configured to control the intake valve Va to control the timing to open and close by shifting, or changing the relative rotational phase.

The outer rotor 20 is configured with a cylindrical rotor body 21, a rear block 22 and a front plate 23. The rear block 22 positioned to be in contact with one end portion of the rotor body 21 in a direction along the rotary axis X and the front plate 23 positioned to be in contact with the other end portion of the rotor body 21 in the direction along the rotary axis X are fixed on the rotor body 21 using plural joining bolts 24. The driving sprocket 22S transmitted the rotational force from the crankshaft 1 is formed at an outer circumference of the rear block 22. The rotor body 21 is integrally formed with a cylindrical inner wall portion 121 and plural protrusions 21T protruding in the direction to be close to the rotary axis X (radially inward).

In particular, at least one of the rear block 22 and the front plate 23 includes a small clearance between either the rear block 22 or the front plate 23 and the rotor body 21 in a state where the rear block 22 and the front plate 23 are joined with the rotor body 21 using the joining bolt 24. Accordingly, the clearance allows to slightly leak hydraulic oil, which is an example of a fluid, remaining in a fluid pressure chamber C.

A pair of guide grooves 100 is formed in a radial direction about the rotary axis X relative to the single protrusion 21T. A plate-shaped lock member 25 is inserted into the guide groove 100 in a projectable and retractable manner. Further, a lock spring 26 as a biasing means to bias the lock member 25 in a direction to be close to the rotary axis X is provided inside the rotor body 21. A first lock mechanism L1 is configured with one of the lock members 25 and the lock spring 26 biasing the lock member 25 in a protruding direction of the lock member 25. A second lock mechanism L2 is configured with the other lock member 25 and the lock spring 26 biasing the lock member 25 in the protruding direction of the lock member 25. The lock member 25 is not limited to be formed in the plate-shape and, for example, a rod-shaped lock member may be applied.

A broader concept of the first lock mechanism L1 and the second lock mechanism L2 is defined as a lock mechanism L. A section including the pair of the lock members 25 and the corresponding lock springs 26 of the plural protrusions 21T is dedined as a lock mechanism positioning portion 21W.

Figure 3:
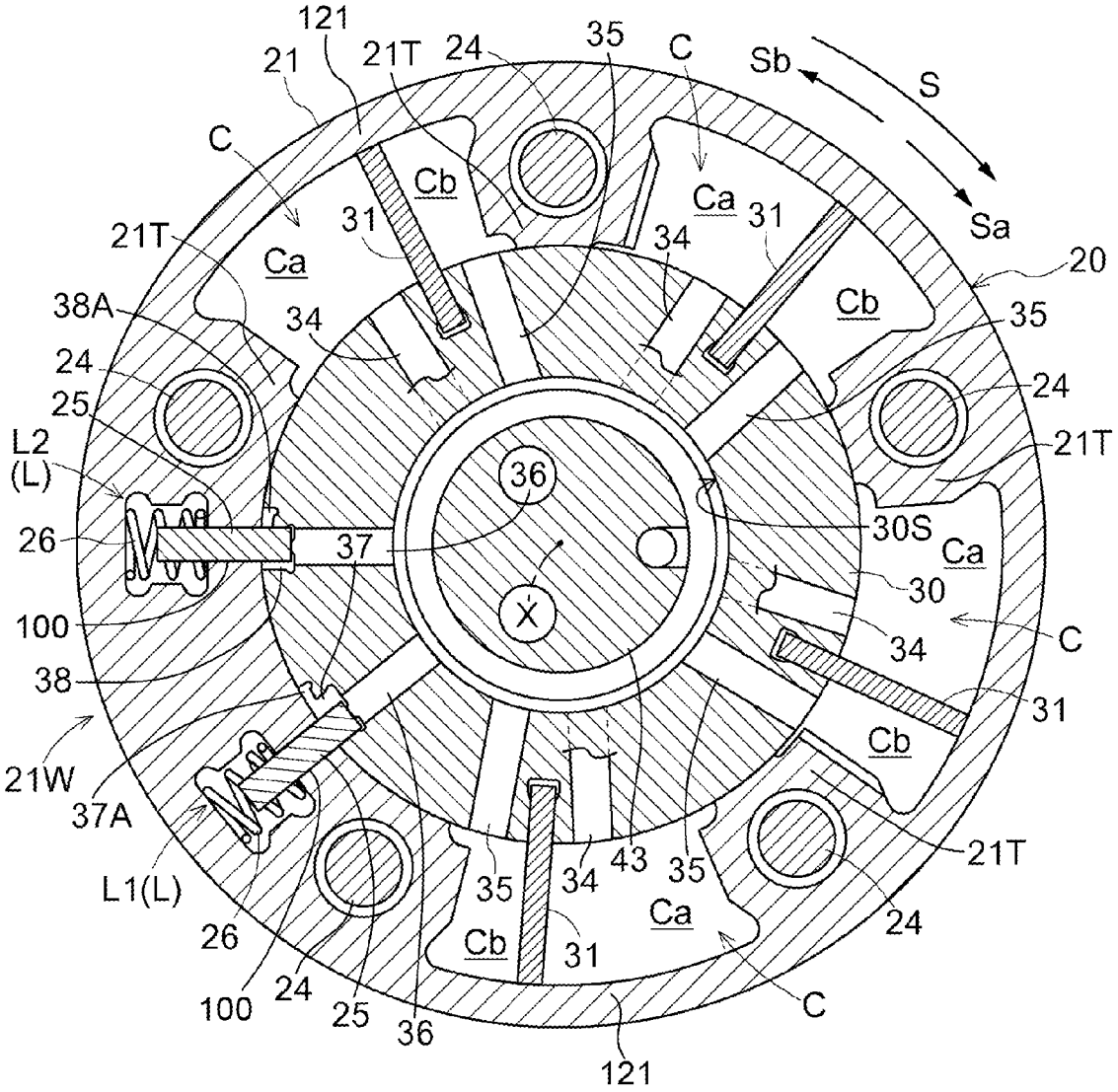
FIG. 3 is a cross-sectional view of the variable valve control apparatus taken along line III-III in FIG. 2.
Figure 4:
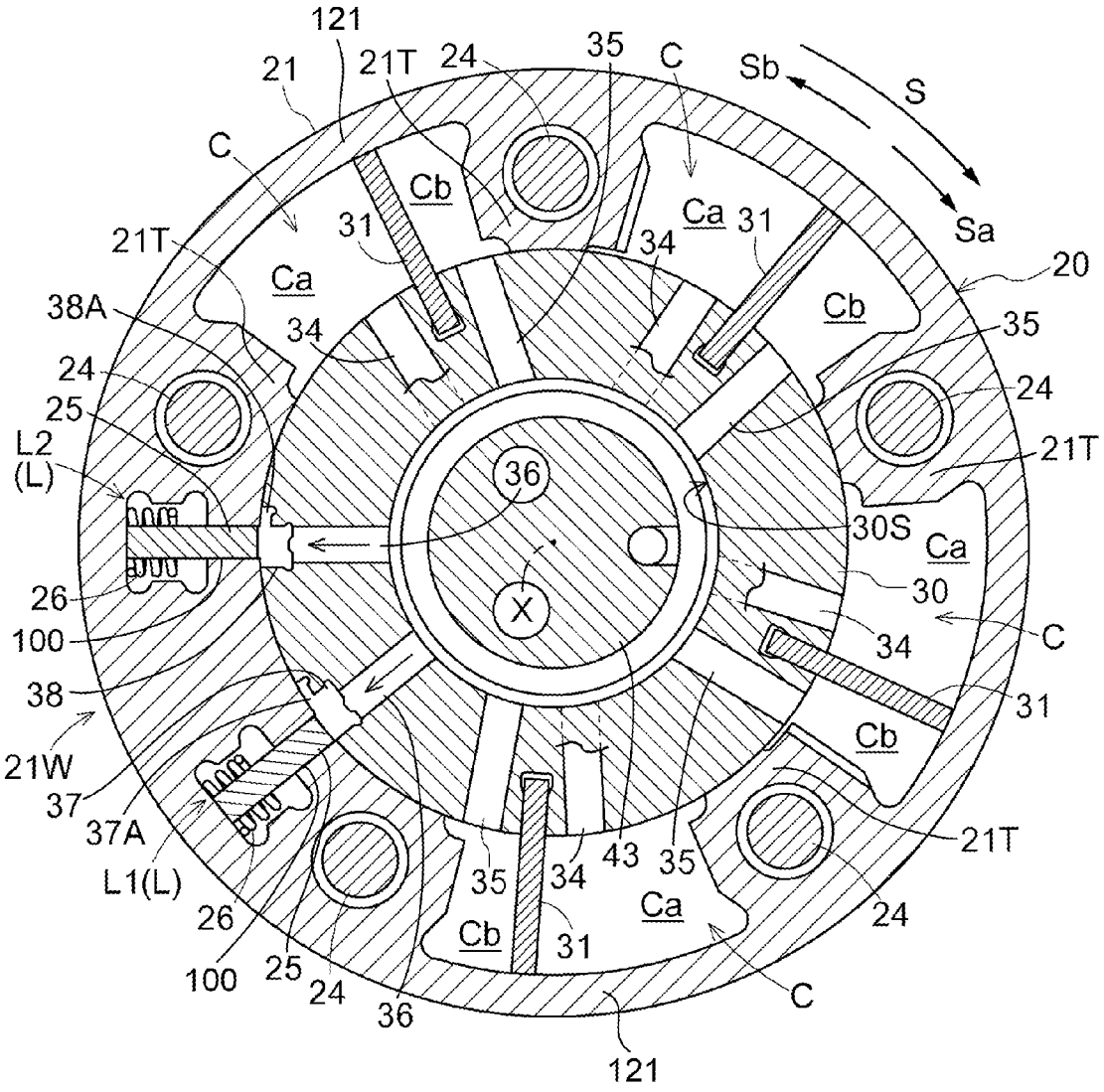
FIG. 4 is a cross-sectional view of the variable valve control apparatus in a state where a lock member is unlocked.
Figure 5:
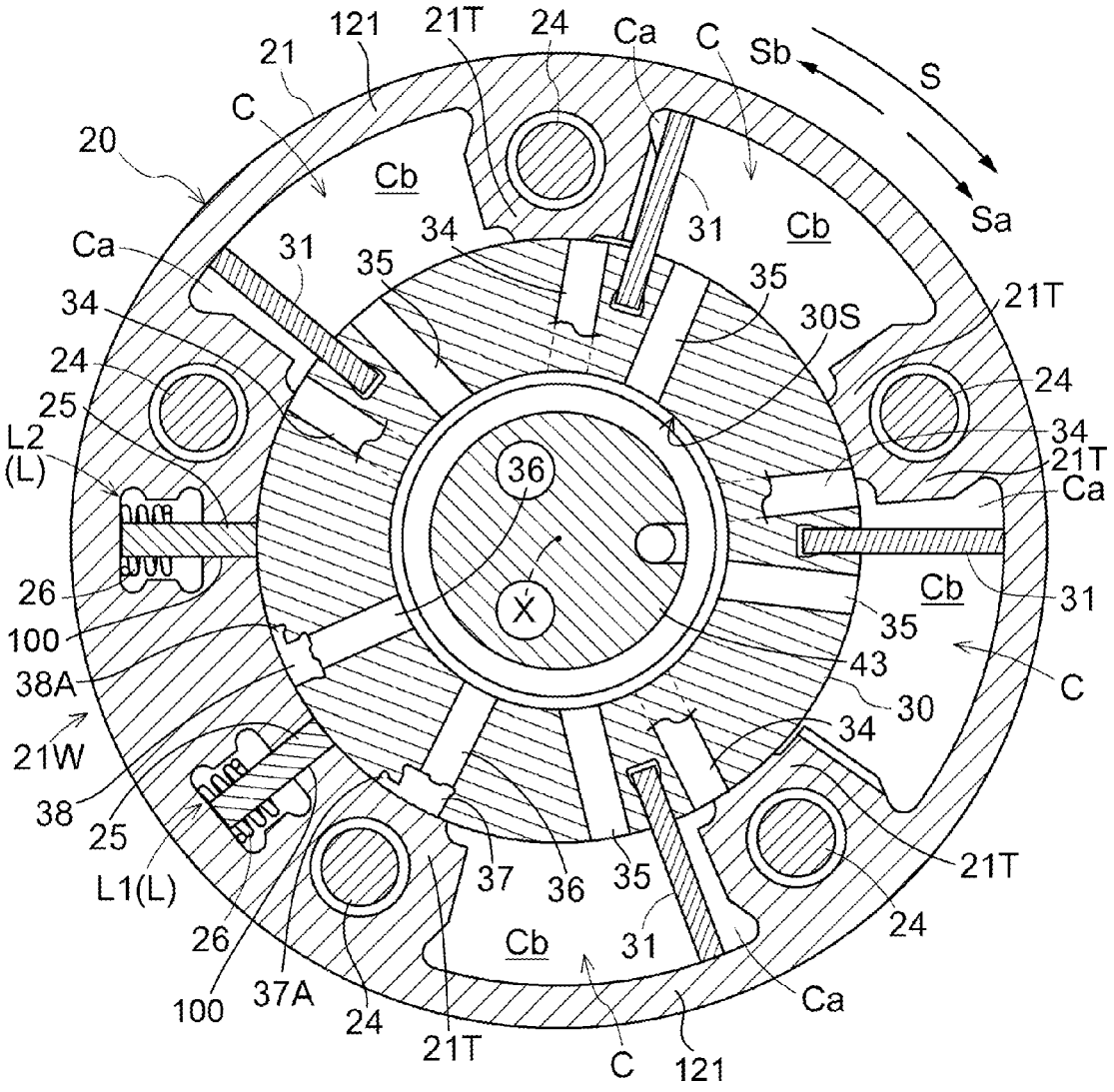
FIG. 5 is a cross-sectional view of the variable valve control apparatus in the most retarded angle phase.

The inner rotor 30 includes a cylindrical inner circumferential surface 30S coaxially formed with the rotary axis X and an outer circumferential surface surrounding around the rotary axis X. Plural vanes 31 protruding outward of the inner rotor 30 are fitted into an outer circumferential portion of the inner rotor 30. A flange portion 32 is formed at one end portion of the inner rotor 30 in the direction along the rotary shaft X. On an inner circumference of the flange portion 32, the inner rotor 30 is connected with the intake cam shaft 7*a* using a connection bolt 33 that is positioned inside a hole portion coaxially formed with the rotary axis X. As illustrated in FIGS. 3 to 5, an advanced angle path 34 communicating with an advanced angle chamber Ca, a retarded angle path 35 communicating with a retarded angle chamber Cb, and a pair of unlock paths 36 are formed at the inner rotor 30.

The outer circumferential surface of the inner rotor 30 is in contact with the protruding ends of the plural protrusions 21T of the rotor body 21 of the outer rotor 20. The protruding amount of each of the vanes 31 is set to be a value in which the protruding ends of the plural vanes 31 are in contact with the cylindrical inner wall portion 121 of the rotor body 21. As the inner rotor 30 is fitted in the outer rotor 20, the fluid pressure chamber C is formed to be surrounded, or defined by an inner portion (the cylindrical inner wall portion 121 and the plural protrusions 21T) of the rotor body 21, and the outer circumferential surface of the inner rotor 30. The vane 31 divides the fluid pressure chamber C to form the advanced angle chamber Ca and the retarded angle chamber Cb.

A first lock recessed portion 37, serving as a recessed portion, engaging and disengaging with the lock member 25 of the first lock mechanism L1 as well as a second lock recessed portion 38, serving as a recessed portion, engaging and disengaging with the lock member 25 of the second lock mechanism L2 are formed at the outer circumference of the inner rotor 30. The first lock recessed portion 37 and the second lock recessed portion 38 are formed as recessed portions recessed in the direction toward the rotary axis X relative to the outer circumferential surface of the inner rotor 30. The first lock recessed portion 37 communicates with one of the pair of the unlock paths 36 while the second lock recessed portion 38 communicates with the other of the pair of the unlock paths 36. Further, the first lock recessed portion 37 and the second lock recessed portion 38 are positioned between the advanced angle path 34 communicating with the advanced angle chamber Ca and the retarded angle path 35 communicating with the retarded angle Cb.

The first lock recessed portion 37 is formed consecutively with a first latchet portion 37A shallower than the first lock recessed portion 37. The second lock recessed portion 38 is formed consecutively with a second latchet portion 38A shallower than the second lock recessed portion 38.

The relative position of the first and second latchet positions 37A and 38A is set such that the lock member 25 of the first lock mechanism L1 engages with the first latchet portion 37A, and then, the lock member 25 of the second lock mechanism L2 engages with the second latchet portion 38A when the relative rotational phase shifts, or change in an advanced angle direction Sa from the retarded angle position. When the first and second lock mechanisms L1 and L2 are disengaged and the relative rotational phase further shifts, or changes to the advanced angle direction Sa, the lock member 25 of the first lock mechanism L1 engages with the first lock recessed portion 37, and then, the lock member 25 of the second lock mechanism L2 engages with the second lock recessed portion 38 to fix the relative rotational phase on an intermediate lock phase as illustrated in FIG. 3.

A torsion spring 27 extending from the rear block 22 of the outer rotor 20 to the inner rotor 30 is provided. The torsion spring 27 applies biasing force to the variable valve timing control apparatus A until at least an intermediate lock phase is established from, for example, a most retarded angle phase.

According to the variable valve timing control apparatus A of the embodiment, the inner rotor 30 is surrounded by the outer rotor 20 to form the fluid pressure chamber C. The vane 31 divides the fluid pressure chamber C to form the advanced angle chamber Ca and the retarded angle chamber Cb. The advanced angle path 34 communicates with the advanced angle chamber Ca while the retarded angle path 35 communicates with the retarded angle chamber Cb. Further, the relative position of the lock members 25 of the first lock mechanism L1 and the second lock mechanism L2 is such that the lock member 25 of the first lock mechanism L1 engages with the first lock recessed portion 37 while the lock member 25 of the second lock mechanism L2 engages with the second lock recessed portion 38.

According to the variable valve timing control apparatus A of the embodiment, the outer rotor 20 rotates in a driving rotational direction S by driving force transmitted by the timing chain 6. The rotating direction of the inner rotor 30 in the same direction as the driving rotational direction S relative to the outer rotor 20 is defined as the advanced angle direction Sa while the reverse direction of the aforementioned rotating direction of the inner rotor 30 is defined as the retarded angle direction Sb. According to the variable valve timing control apparatus A of the embodiment, the relation of the crankshaft 1 and the intake cam shaft 7*a* is set to increase an intake compression rate as the displacement amount of the relative rotational phase increases in a state where the relative rotational phase shifts, or changes in the advanced angle direction Sa while decreasing the intake compression rate as the displacement amount increases in a state where the relative rotational phase shifts, or changes in the retarded direction Sb.

The relative rotational phase shifts, or changes in the advanced angle direction Sa when the hydraulic oil is supplied to the advanced angle chamber Ca. The relative rotational phase shifts, or changes in the retarded angle direction Sb when the hydraulic oil is supplied to the retarded angle chamber Cb. When the vane 31 reaches a movement end, that is, a rotational limit about the rotary axis X, in the advanced angle direction Sa, the relative rotational angle phase is defined as a most advanced angle phase. When the vane 31 reaches the movement end, that is, the rotational limit about the rotary axis X, in the retarded angle direction Sb, the relative rotational angle phase is defined as a most retarded angle phase.

The most retarded angle phase is not limited to the movement end in the retarded angle direction and covers close to the movement end including the most retarded angle phase. Similarly, the most advanced angle phase is not limited to the movement end in the advanced angle direction and covers close to the movement end.

A valve unit VU includes a phase control valve 41 and a lock control valve 42 accommodated in a unit case and is configured such that a path forming shaft portion 43 integrally formed with the unit case is positioned inside the inner rotor 30. Respective circumferential groove portions communicating with a port of the phase control valve 41 and a port of the lock control valve 42 are formed on an outer circumference of the path forming shaft portion 43. Plural ring-shaped seals 44 are provided between the outer circumference of the path forming shaft portion 43 and the inner circumferential surface 30S of the inner rotor 30 to separate the groove portions from one another.

The engine E includes an oil pressure pump P driven by the engine E to supply oil remaining at an oil pan to apply as the hydraulic oil. Respective paths are formed for supplying the hydraulic oil pumped by the oil pressure pump P to the phase control valve 41 and the lock control valve 42.

The ECU B controls the electro-magnetic phase control valve 41 and the electro-magnetic lock control valve 42 to control intake air timing. The phase control valve 41 and the lock control valve 42 are accommodated in the single valve unit VU. A section of the single valve unit VU is positioned inside the variable valve timing control apparatus A.

The ECU B controls the engine E by using software, for example, a microprocessor and a digital signal processing, or DSP. The ECU B includes an engine ignition portion 51, a relative rotational phase setting portion 52 and an engine stop control portion 53 all configured using software. Alternatively, the engine ignition portion 51, the relative rotational phase setting portion 52 and the engine stop control portion 53 may be configured using hardware, or a mixture of software and hardware.

By acquiring the information from the ignition switch 15, the engine ignition portion 51 operates the starter motor 12 and starts the engine E by controlling the ignition plug 10 and the fuel-injection nozzle 11. When the engine is started, the relative rotational phase setting portion 52 receives feedback of the relative rotational phase from the opening/closing timing sensor 14 in accordance with the rotary speed and the load of the engine E. Then, the relative rotational phase setting portion 52 controls the valve unit VU and set the relative rotational phase of the variable valve timing apparatus A to the required value. By setting the relative rotational phase, the efficient combustion of fuel-air mixture and the fuel-efficient operation of the engine E are realized.

The vehicle with the variable valve timing control apparatus A of the embodiment is configured to operate an idle stop control and a manual stop control. In the idle stop control, the engine E is controlled to be stopped automatically when a driver performs a brake operation. In the manual stop control, the engine E is controlled to be stopped when the driver operates the ignition switch 15 when the engine E is in operation. Regardless of the idle stop control or the manual stop control, the engine stop control portion 53 controls the engine E to set the relative rotational phase of the variable valve timing control apparatus A to a phase suitable for starting the engine E, and further controls the engine E to be stopped when the predetermined piston 4 of the plural pistons 4 reaches a point close to a bottom dead center in the intake stroke. When these controls are operated, the ignition plug 10 and the fuel-injection nozzle 11 are controlled to stop the engine E. When the piston 4 is displaced from the desired position, the starter motor 12 shifts the piston 4 to the desired position before the piston 4 is stopped.

Figure 6:
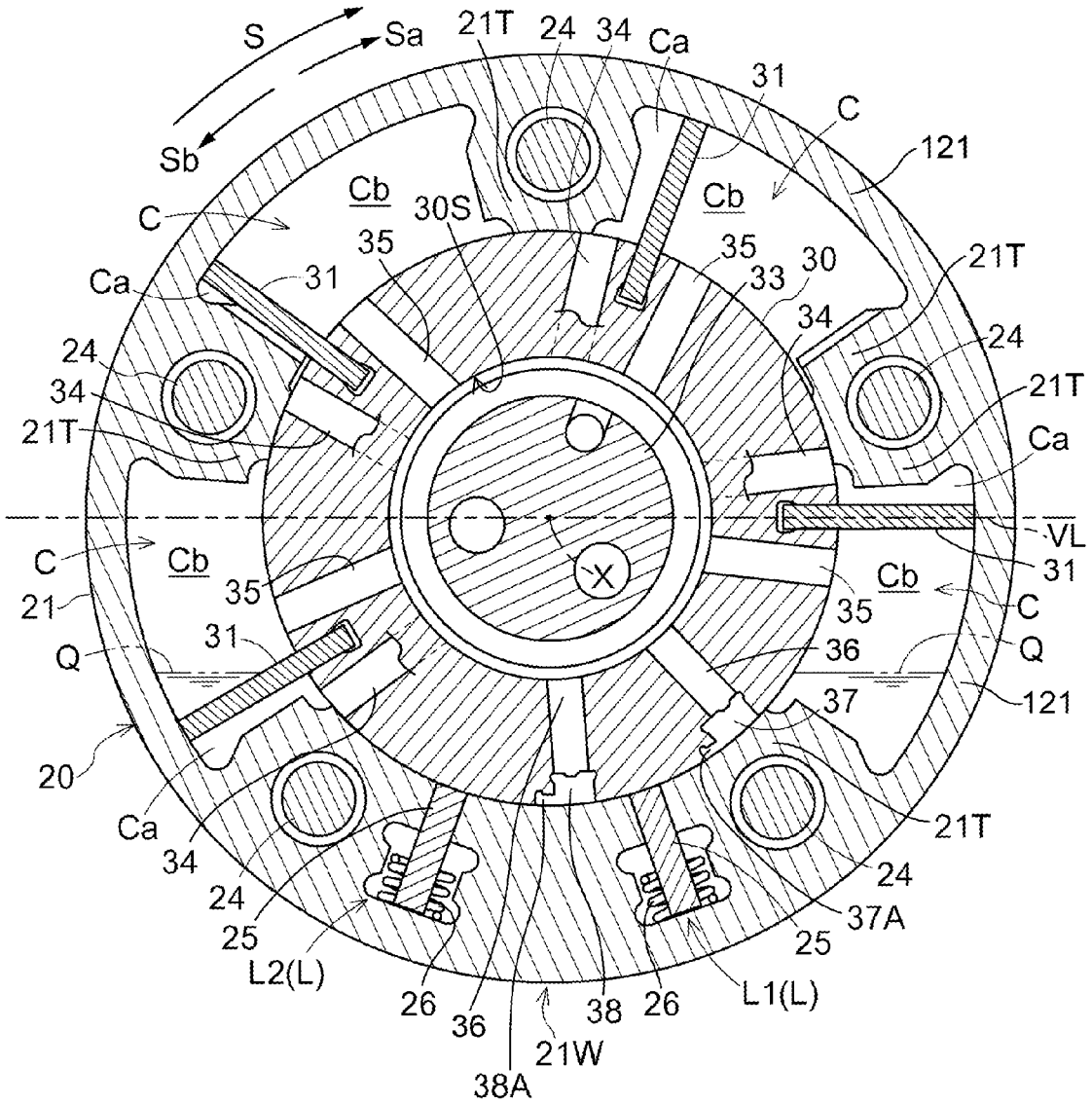
FIG. 6 is a cross-sectional view of the variable valve control apparatus when the engine is stopped.
Figure 7:
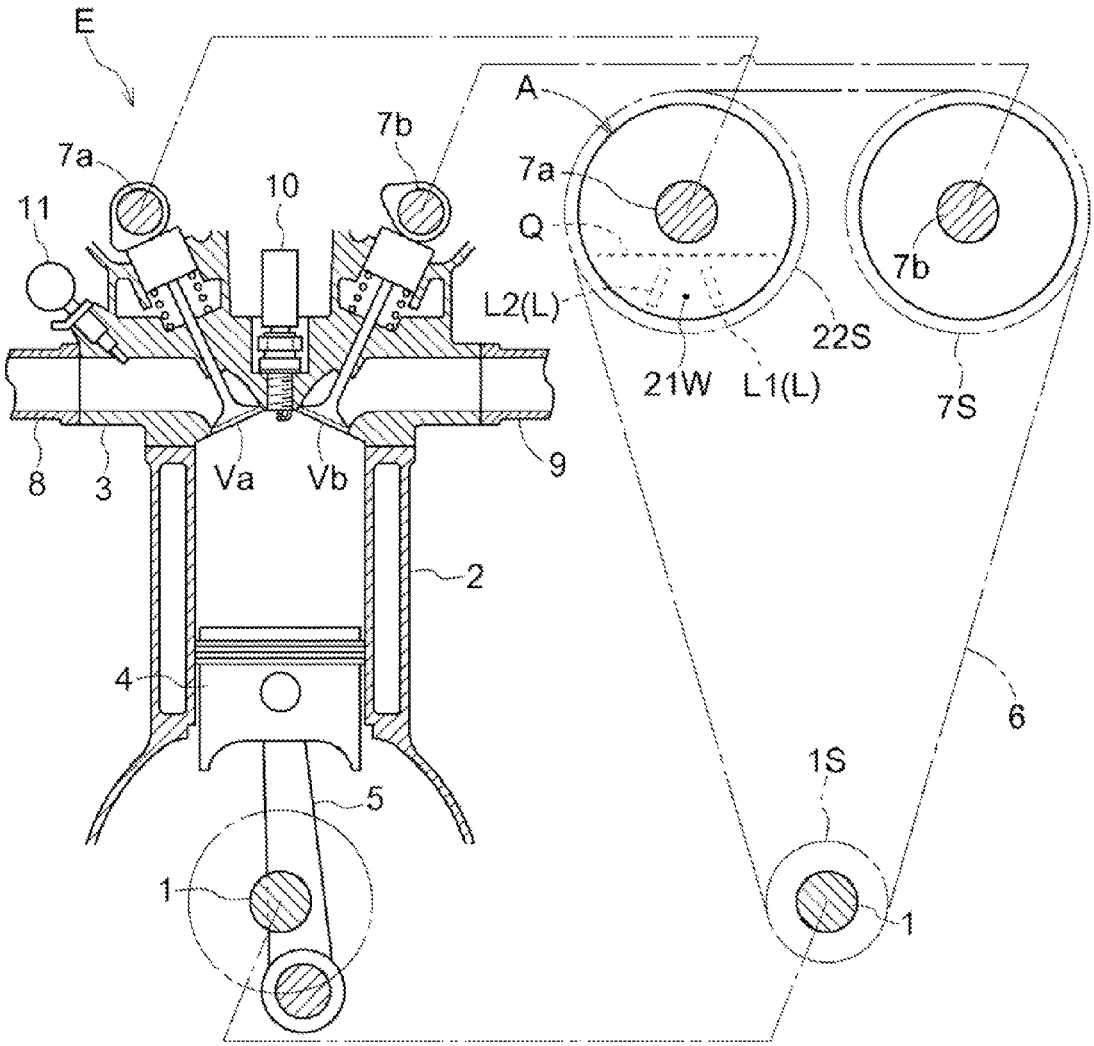
FIG. 7 is a schematic view illustrating the relation of the engine and the variable valve control apparatus when the engine is stopped.

As illustrated in FIGS. 6 and 7, when the engine E is stopped, the predetermined piston 4 of the plural pistons 4 reaches close to the bottom dead center in the inspiration process. At the same time, the lock mechanism positioning portion 21W is positioned at the lowermost position below a virtual line VL passing though the rotary axis X when the engine E is stopped. Accordingly, the hydraulic oil is leaked from the small clearance formed between at least one of the rear block 22 and the front plate 23, and the rotor body 21.

According to the variable valve timing control apparatus A, a path supplying/discharging the hydraulic oil to/from both of the advanced angle path 34 and the retarded angle path 35 via the phase control valve 41 and a path supplying/discharging the hydraulic oil to/from the unlock path 36 via the lock control valve 42 are formed close to the rotary axis X. According to the aforementioned configuration, the hydraulic oil remaining in the fluid pressure chamber C is discharged via the paths positioned close to the rotary shaft X when the engine E is stopped.

Due to the leak and the outflow via the paths in the variable valve timing control apparatus A, the hydraulic oil is discharged from the fluid pressure chamber C. In response to the discharge of the hydraulic oil, air flows into the fluid pressure chamber C, resulting in that a liquid level Q of the fluid pressure chamber C is decreased as illustrated in FIG. 6. The decreasing rate of the liquid level Q is comparatively fast before reaching close to the rotary axis X. However, after the liquid level Q is decreased below the virtual line VL passing though the rotary axis X, the decreasing rate of the liquid level Q slows down because the hydraulic oil is discharged only by leakage. Further, as illustrated in FIG. 6, in a state where the decreasing rate of the liquid level Q slows down, the hydraulic oil may remain at the bottom of the variable valve timing control apparatus A after the liquid level Q of the hydraulic oil remaining in the fluid pressure chamber C reaches below the virtual line VL passing through the rotary axis X because the viscosity of the hydraulic oil is increased due to the temperature decrease of the engine E.

However, according to the engine E of the disclosure, the lock mechanism positioning portion 21W is positioned below the virtual line VL passing through the rotary axis X when the engine E is stopped. Accordingly, in a state where the hydraulic oil remains in the variable valve timing control apparatus A, the hydraulic oil remained in the fluid pressure chamber C positioned above the fluid pressure chamber C which is positioned close to the lock mechanism positioning portion 21W may be discharged completely. When the engine E is started, the hydraulic oil is supplied to one of the advanced angle chamber Ca and the retarded angle chamber Cb in response to the cranking by the drive of the starter motor 12 to shift, or change the relative rotational phase. Thus, the engine E may be started at the most favorable relative rotating phase by changing the relative rotational phase quickly because the hydraulic oil remaining in the fluid chamber C and acting in a direction to restrain the operation of the vane 31 is discharged.

According to the engine E of the disclosure, the lock mechanism positioning portion 21W does not have to be positioned directly below the virtual line VL passing through the rotary shaft X. In a case where the fluid pressure chamber is positioned directly below the virtual line VL passing through the rotary axis X, one of the advanced angle chamber Ca and the retarded angle chamber Cb may favorably be positioned higher than the other of the advanced angle chamber Ca and the retarded angle chamber Cb. Accordingly, the hydraulic oil may be discharged from one of the advanced angle chamber Ca and the retarded angle chamber Cb, resulting in that the relative rotational phase may be changed quickly when the engine E is started.

For example, when the relative rotational phase is locked at the most retarded angle phase due to abnormal stop of the engine E, most of the hydraulic oil remaining in the fluid pressure chamber C flows out. Accordingly, when starting the engine E which is in a cold state, the hydraulic oil is supplied to the advanced angle chamber Ca in response to the cranking by the drive of the starter motor 12 to shift, or change the relative rotational phase to the intermediate lock phase. Thus, the engine E may be started at the most favorable relative rotating phase by changing the relative rotational phase quickly because the hydraulic oil remaining in the fluid chamber C and acting in a direction to restrain the operation of the vane 31 is discharged.

The aforementioned embodiment of the disclosure may be modified as below.

A recessed portion may be formed at the outer rotor 20 while the lock member 25 engaging and disengaging the recessed portion is formed at the inner rotor 30 to include the lock mechanism L. Alternatively, as the lock mechanism L, the single lock member 25 may be formed at one of the outer rotor 20 and the inner rotor 30 while a single recessed portion may be formed at the other of the outer rotor 20 and the inner rotor 30 at the lock mechanism positioning portion 21W. By positioning the lock mechanism positioning portion 21W below the virtual line VL passing through the rotary axis X when the engine E is stopped, the hydraulic oil remaining in the fluid pressure chamber C may be discharged.

A recessed portion for engaging with the lock member 25 of the second lock mechanism L2 may be formed to establish and lock the relative rotational phase at the most retarded angle phase. At the same time, the variable valve timing control apparatus A may be configured with an oil pressure source as an unlock means. Then, when the engine E is started in a state where the variable valve timing control apparatus A is, for example, in the most retarded angle phase, the relative rotational phase may be quickly shifted, or changed to the intermediate lock phase.

The engine E of the disclosure may be mounted to a vehicle including a hybrid system. The hybrid system charges a battery using the drive force of the engine E and controls the engine E to be stopped after fixing the variable valve timing control apparatus A at the most retarded angle phase using the lock mechanism L when charging the battery is completed. For example, when the engine E stopped after the completion of the battery charge dissipates heat and is in a cold state, the engine E may be started favorably by shifting, or changing the relative rotational phase of the variable valve timing control apparatus A in the advanced angle direction Sa quickly.

This disclosure may be applied to an engine provided with a variable valve timing control apparatus including an advanced angle chamber, a retarded angle chamber, and a lock mechanism.

According to the embodiment of the disclosure, the engine E (internal combustion engine) includes the variable valve timing control apparatus A including the outer rotor 20 (driving-side rotating member) rotating about the rotary axis X by rotational force transmitted from the crankshaft 1 of the engine E (internal combustion engine), the inner rotor 30 (driven-side rotating member) being surrounded by the outer rotor 20 (driving-side rotating member) to include at least one of the fluid pressure chambers C partitioned and formed with at least one of the advanced angle chambers Ca and at least one of the retarded angle chambers Cb between the inner rotor 30 (driven-side rotating member) and the inner portion of the outer rotor 20 (driving-side rotating member), the inner rotor (driven-side rotating member) integrally rotating with the camshaft 7*a* for opening and closing the valve, and the lock mechanism L, L1, L2 configured with the lock member 25 provided at one of the outer rotor 20 (driving-side rotating member) and the inner rotor 30 (driven-side rotary member) to be engageable and disengageable with the recessed portion 37, 38 formed at the other of the outer rotor 20 (driving-side rotating member) and the inner rotor 30 (driven-side rotary member). The engine E (internal combustion engine) further includes the ECU B (engine control unit) for stopping the engine E (internal combustion engine) to position a portion where the lock mechanism L is formed below the virtual line VL passing through the rotary axis X and extending in the horizontal direction when the engine E (internal combustion engine) is stopped.

The variable valve timing apparatus A of the embodiment is configured to slightly leak the fluid (hydraulic oil) remaining in the fluid pressure chamber C. In response to the leak of the fluid (hydraulic oil) from the fluid pressure chamber C, air flows into the fluid pressure chamber C from outside, resulting in that the liquid level Q in the fluid pressure chamber C is lowered gradually. According to the variable valve timing control apparatus A of the embodiment, the paths for supplying the fluid (hydraulic oil) that changes the relative rotational phase are formed close to the rotary axis X while the phase control valve 41 and the lock control valve 42 for controlling the fluid (hydraulic oil) supplying to and discharging from the paths is provided outside of the variable valve control apparatus A. When the internal combustion engine (engine E) is stopped, a phenomenon which the fluid (hydraulic oil) in the fluid pressure chamber C is discharged via the paths may occur. Thus, the liquid level Q of the fluid (hydraulic oil) remaining in the fluid pressure chamber C may be lowered due to the phenomenon which the fluid (hydraulic oil) leaks and which the fluid (hydraulic oil) is discharged outside via the paths when the internal combustion engine (engine E) is stopped. The decreasing rate of the liquid level Q is comparatively fast before reaching close to the rotary axis X. After reaching below the virtual line VL passing through the rotary axis X, the decreasing rate of the liquid level Q slows down because the fluid (hydraulic oil) is discharged only by leakage. Further, the hydraulic oil may remain at the bottom of the variable valve timing control apparatus A because the viscosity of the hydraulic oil is increased due to the temperature decrease of the engine E. However, according to this disclosure, the lock mechanism positioning portion 21W is positioned below the virtual line VL passing through the rotary axis X when the internal combustion engine (engine E) is stopped. Thus, in a state where the liquid level Q is not sufficiently lowered because the viscosity of the fluid (hydraulic oil) is increased due to the temperature decrease of the engine E, the fluid (hydraulic oil) remaining in the fluid pressure chamber C positioned above the fluid pressure chamber C which is positioned close to the lock mechanism (L, L1, L2) may be discharged. When the internal combustion engine (engine E) is started, the fluid (hydraulic oil) is supplied to the fluid pressure chamber C to change the relative rotational phase of the variable valve timing control apparatus A. The relative rotational phase may be changed to the desired phase quickly by reducing a resistance applied by the fluid (hydraulic oil) remained in the fluid pressure chamber C and acting in the direction to restrain the shift, or change of the relative rotational phase. As a result, the internal combustion engine (engine E) may quickly shift, or change the relative rotational phase of the variable valve timing control apparatus A to the desired phase when the internal combustion engine (engine E) is started.

According to the embodiment of the disclosure, the variable valve timing control apparatus A includes the plural fluid pressure chambers C and the ECU B (engine control unit) controls the engine E (internal combustion engine) to be stopped at the position where said one of the advanced angle chamber Ca and the retarded angle chamber Cb is positioned higher than said the other of the advanced angle chamber Ca and the retarded angle chamber Cb when one of the plural of advanced angle chambers Ca and the plural of retarded angle chambers Cb is positioned below the virtual line VL.

According to the aforementioned configuration, in a case where at least one of the plural fluid pressure chambers C is positioned below the virtual line VL passing through the rotary axis X when the internal combustion engine (engine E) is stopped, the fluid (hydraulic oil) remaining in one of the advanced angle chamber Ca and the retarded angle chamber Cb positioned higher than the other of the advanced angle chamber Ca and the retarded angle chamber Cb may be discharged by the leakage. Thus, comparing to the known variable valve timing control apparatus A which leaves the fluid (hydraulic oil) in both of the advanced angle chamber Ca and the retarded angle chamber Cb, the relative rotational phase of the variable valve timing control apparatus A may be quickly changed when the internal combustion engine (engine E) is started.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An internal combustion engine, comprising:

a variable valve timing control apparatus, including a driving-side rotating member rotating about a rotary axis by rotational force transmitted from a crankshaft of the internal combustion engine, the driving-side rotating member possessing an inner wall;

a driven-side rotating member surrounded by the driving-side rotating member to include at least one fluid pressure chamber partitioned and formed with at least one advanced angle chamber and at least one retarded angle chamber between the driven-side rotating member and an inner portion of the driving-side rotating member, the driven-side rotating member integrally rotating with a camshaft for opening and closing a valve;

a protrusion extending inwardly from the inner wall of the driving-side rotating member; and a lock mechanism configured with a lock member provided at one of the protrusion of the driving-side rotating member and the driven-side rotary member that faces the protrusion to be engageable and disengageable with a recessed portion formed at the other of the protrusion of the driving-side rotating member and the driven-side rotary member that faces the protrusion; and an engine control unit for stopping the internal combustion engine to position a portion where the lock mechanism is formed below a virtual line passing through the rotary axis and extending in a horizontal direction when the internal combustion engine is stopped.

2. The internal combustion engine according to claim 1, wherein the variable valve timing control apparatus includes a plurality of the fluid pressure chambers and the engine control unit controls the internal combustion engine to be stopped at a position where said one of the advanced angle chamber and the retarded angle chamber is positioned higher than said the other of the advanced angle chamber and the retarded angle chamber when one of the plurality of advanced angle chambers and the plurality of retarded angle chambers is positioned below the virtual line.

3. The internal combustion engine according to claim 1, wherein the lock member moves radially to engage the recessed portion and to disengage the recessed portion.

4. The internal combustion engine according to claim 1, wherein a relative rotation phase exists between the driving-side rotating member and the driven-side rotating member, the relative rotation phase including a most advanced angle phase and a most retarded angle phase, and the lock mechanism engages the recessed portion to lock the relative rotation phase at an intermediate lock phase, the intermediate lock phase being between the most advanced angle phase and the most retarded angle phase.

5. The internal combustion engine according to claim 1, wherein a lock spring biases the lock member towards the rotary axis of the driving-side member.

6. The internal combustion engine according to claim 1, wherein the lock member is a first lock member, and the lock mechanism further comprising a second lock member, and wherein when the engine control unit stops the internal combustion engine, both the first lock member and the second lock member are positioned below the virtual line passing through the rotary axis and extending in the horizontal direction.

* * * * *